US006336729B1

(12) United States Patent
Pavelle et al.

(10) Patent No.: US 6,336,729 B1
(45) Date of Patent: Jan. 8, 2002

(54) EMERGENCY LIGHT DEVICE

(76) Inventors: Richard Pavelle, 23 Berkshire Dr., Winchester, MA (US) 01890; Sol Aisenberg, 36 Bradford Rd., Natic, MA (US) 01760; George Freedman, 5 Brook Trail Rd., Wayland, MA (US) 01788; Hed A. Ze'ev, 12 Wagon Trail Dr., Nashua, NH (US) 03062

( * ) Notice: Subject to any disclaimer, the term of this patent is extended or adjusted under 35 U.S.C. 154(b) by 0 days.

(21) Appl. No.: 09/511,479

(22) Filed: Feb. 23, 2000

Related U.S. Application Data

(60) Provisional application No. 60/134,986, filed on May 20, 1999.

(51) Int. Cl.[7] ..... F21V 21/00

(52) U.S. Cl. ..... 362/34; 362/84; 362/208; 362/375; 340/628; 340/331

(58) Field of Search ..... 362/34, 84, 155, 362/154, 200, 208, 226, 204, 190, 191; 340/331, 332

(56) References Cited

U.S. PATENT DOCUMENTS

| | | | | | |
|---|---|---|---|---|---|
| 3,653,342 | A | * | 4/1972 | Chilton | 109/31 |
| 3,798,437 | A | | 3/1974 | Sarbacher | 5/610 |
| 3,940,605 | A | | 2/1976 | Gerber | 362/34 |
| 4,405,973 | A | | 9/1983 | Moscarillo | 362/34 |
| 4,617,561 | A | * | 10/1986 | Brown | 340/628 |
| 4,814,949 | A | | 3/1989 | Elliott | 362/34 |
| 5,028,911 | A | | 7/1991 | Wanat et al. | 340/691.8 |
| 5,173,218 | A | | 12/1992 | Cohen et al. | 252/700 |
| 5,348,690 | A | | 9/1994 | Cohen et al. | 252/700 |
| 5,406,463 | A | | 4/1995 | Schexnayder, Sr. | 362/34 |
| 5,446,629 | A | * | 8/1995 | Steiger | 362/34 |
| 6,033,080 | A | * | 3/2000 | Hasegawa | 340/628 |

* cited by examiner

*Primary Examiner*—Alan Cariaso
*Assistant Examiner*—Hargobino S. Sawhney
(74) *Attorney, Agent, or Firm*—Christopher H. Hunter

(57) ABSTRACT

A lighting system includes a base, and a cover pivotally connected to the base. In one embodiment, a portable flashlight is supported within a holder fixed to the base. The flashlight includes a housing enclosing a light bulb, a battery, and an electrical circuit electrically interconnecting the light bulb and the battery. The circuit includes a pair of contacts, which are normally biased together to complete the circuit between the battery and light bulb. An insulating member is interposed between the contacts when the flashlight is primed, and becomes fixed to the cover when the cover is closed. When the cover is then opened, the insulating member is removed from between the contacts, which illuminates the flashlight. According to a further embodiment, a chemiluminescent stick is supported within the holder. A break bar pivotally connected to the cover is initially in a vertical orientation, and temporarily retained by a latch to allow insertion of the light stick in the holder and closure of the cover. When the cover is closed, the latch is released, which allows the break bar to move behind the light stick, in a horizontal orientation. When the cover is then opened, the break bar engages the light stick, and bends the light stick forward around an edge to illuminate the light stick. In either embodiment, the illuminated flashlight or light stick can be easily removed from the holder to illuminate the surrounding area and facilitate exiting a facility.

25 Claims, 4 Drawing Sheets

EMERGENCY LIGHT DEVICE

RELATED CASES

The present application claims the benefit of the filling date of U.S. Provisional Application Ser. No. 60/134,986; filed May 20, 1999.

FIELD OF THE INVENTION

The present invention relates generally to emergency lighting systems, and more particularly to a portable light device that is automatically and irreversibly activated upon removal from an enclosure for use during an emergency situation.

BACKGROUND OF THE INVENTION

Emergency lighting systems are known, for example, which comprise battery-operated lighting devices fixedly mounted at strategic locations around a facility, and which are automatically activated when the primary lighting system fails. Such lighting devices, while effective, cannot be removed by the occupants of the facility during an emergency situation, rather the occupants must rely upon a number of such devices to adequately illuminate the occupied areas and the exits from the facility. Such devices add complexity and expense to the facility, both in terms of original purchase and continuing maintenance.

Portable light devices are also known in the form of a flashlight or chemiluminescent light stick which can be easily transported throughout a facility in the event of emergency, and provide individualized illumination for the occupants as they exit the facility. While such portable devices are less expensive than the fixed devices, it can be difficult to locate such devices in the event of emergency if such devices are kept in a storage compartment such as a closet or drawer. On the other hand, if such portable devices are mounted for easy access, the devices can be subject to theft or misuse, and thereby not available during the emergency situation.

One solution is shown in Brown, U.S. Pat. No. 4,617,561, where a flashlight is removeably mounted to a bracket fixed to a base. A portion of the bracket physically and electrically separates the battery terminals of the flashlight. When the flashlight is removed, the terminals are biased together to activate the flashlight. This allows the user to exit the building with the illuminated flashlight during an emergency situation. To decrease the attractiveness of the flashlight for theft or misuse, the flashlight cannot be deactivated once it is removed, except by individuals having an appropriate tool.

Another solution is shown in Steiger, et al., U.S. Pat. No. 5,446,629, where a chemiluminescent light stick is supported in a mount assembly. A cover is pivotally attached to the mount assembly. When the cover is opened, a break plate attached to the cover bends the light stick about a restraining plate on the mount assembly, thereby causing the chemicals of the light stick to intermix and illuminate. The light stick can then be easily removed from the mount assembly and used to exit the facility. The attractiveness of the light stick for theft or misuse is also decreased because it cannot be "de-activated" once the stick is removed.

Such lighting devices as in Brown and Steiger have apparently had some success in the marketplace. Applications for such devices include subway tunnels, stairwells, corridors, fire escape routes, utility rooms, furnace rooms, electrical and communication control centers, and general uses such as in offices, factories, apartment buildings, commercial establishments, mines, tunnels and vehicles. Nevertheless, it is believed there is a continual demand for new and improved emergency lighting systems, particularly where the light device of the system is portable and can be easily removed and carried with the occupants during exit, but where the light device is automatically and irreversibly activated upon removal so as to deter theft and misuse.

SUMMARY OF THE PRESENT INVENTION

The present invention relates to a new and unique emergency lighting system useful to assist occupants exiting a facility during an emergency situation, which includes (at least one) portable light device that is mounted for easy access, and is automatically and irreversibly activated upon removal to deter theft and misuse.

The light device of the present invention is enclosed between a base fixedly attached to a support surface, and a cover which is pivotally connected to the base. The cover can be pivotally moved away from the base to allow easy access to the light device.

According to a first embodiment, the light device comprises a battery-operated portable flashlight that is supported within a holder or bracket fixed to the base. The portable flashlight includes a housing enclosing a light bulb, at least one battery, and an electrical circuit interconnecting the light bulb and battery. The electrical circuit includes a pair of contacts, which are biased together so as to complete the circuit between the battery and light bulb and illuminate the flashlight.

The flashlight is normally maintained in a non-illuminated condition when it is stored for use. To this end, an insulating member is inserted between the contacts during the initial assembly of the flashlight, and the housing of the flashlight is then sealed to prevent internal access. The insulating member has a strip or cord that projects through an opening in the housing and terminates in an activating button, located exterior to the housing. The flashlight is then mounted to the base of the lighting system. When the cover is closed, a fastener on the cover becomes fixedly connected to the activating button of the insulating member. The flashlight is then fully primed and ready for use.

When the cover for the flashlight is later opened, such as during an emergency situation, the insulating member is drawn out from between the contacts by the cooperating fastener and activating button. This allows the contacts to come into contact with one another, completing the electrical circuit between the battery and bulb, and illuminating the flashlight. The illuminated flashlight can then be easily removed from the holder and carried by an occupant to exit the facility.

An important feature of this embodiment is that after the flashlight is removed from the holder, the insulating member cannot be re-inserted between the contacts. The contacts are located in such a manner that the insulating member can only be inserted between the contacts during the initial assembly. Insertion of the insulating member is prevented after assembly without destroying the flashlight, or without a special key or tool to open a portion of the housing. Otherwise, the flashlight remains illuminated until the battery is spent. It is preferred that the battery have a relatively short life span, which is long enough to allow exiting the facility, but which is short enough to deter theft and misuse.

According to a further embodiment of the present invention, the light device comprises a chemiluminescent stick supported within the bracket or holder. A break bar is pivotally connected to the cover, and supported in a plane behind the light stick. Upon initial assembly (priming) of the device, the break bar is moved into a vertical orientation, and temporarily retained by a latch to allow insertion of the light stick in the holder and closure of the cover. When the cover is closed, the latch is released, and the break bar moves into a horizontal orientation, behind the light stick.

When the cover is later opened, the break bar contacts the light stick, and bends the light stick forward. The light stick is bent around a front edge of the holder, which breaks the internal chambers holding the various chemicals, and thereby illuminates the light stick. The illuminated light stick can then be easily removed from the holder, and carried by the occupant to exit the facility. The light stick preferably remains illuminated for a sufficient time to allow exiting the facility, but again, for a time which is short enough to deter theft and misuse.

According to either of the embodiments described above, the emergency lighting system of the present invention provides a light device which automatically illuminates when a cover for the device is opened, and can be easily removed and carried by an occupant to illuminate an exit passage. Again, an important aspect of the invention is that the light device is constructed to be automatically and irreversibly activated upon removal to deter theft and misuse.

The emergency lighting system of the present invention can further include features such as blinking indicator (LED) lights, smoke detectors or audible indicators to indicate proper operation of the light device, as well as to facilitate locating the light device in obscured situations (such as in a smoke-filled room). The lighting system also includes a latching device which retains the cover in its open position until an authorized individual inserts a special key or tool. The LEDs, detectors, indicators and latching devices can also be used to identify the absence of a light device, which increases the effectiveness and reliability of the lighting system.

Further features of the present invention will become apparent to those skilled in the art upon reviewing the following specification and attached drawings.

DETAILED DESCRIPTION OF THE PREFERRED EMBODIMENT

Figure 1:
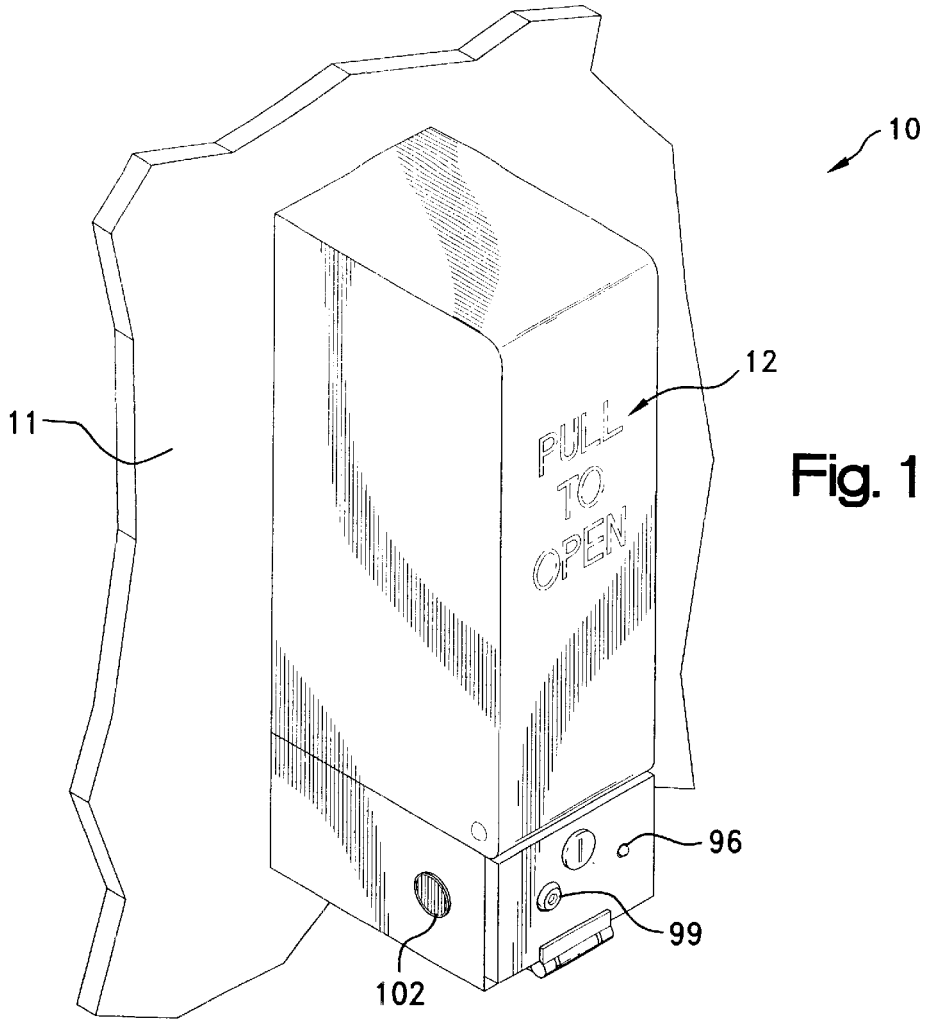
FIG. 1 is an elevated perspective view of an emergency lighting system constructed according to the principles of the present invention with a light device shown mounted within an enclosure.

Referring to the drawings, and initially to FIG. 1, an emergency lighting system is indicated generally at 10. The emergency lighting system is mounted on a support wall or surface 11, at an appropriate height and at an appropriate location. Appropriate indicia as at 12 can be provided on the exterior of the lighting system to provide instructions for the user.

Figure 2:
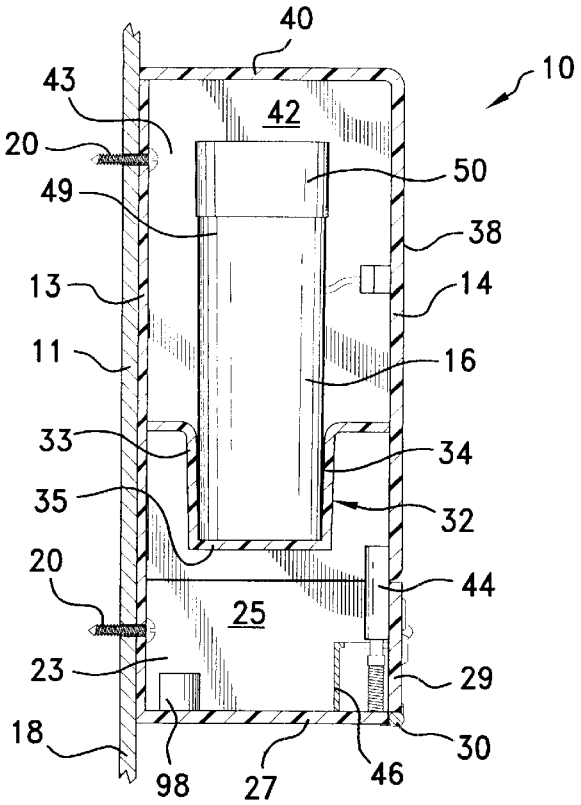
FIG. 2 is a cross-sectional side view of the emergency lighting system of FIG. 1, showing a first embodiment of the light device.
Figure 3:
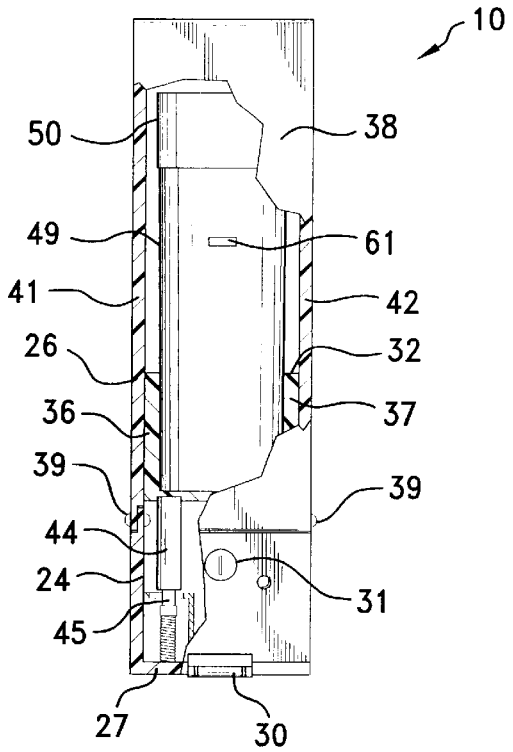
FIG. 3 is a cross-sectional front view of the lighting system of FIG. 1.

Referring now to FIGS. 2 and 3, the emergency lighting system 10 includes a flat base plate 13 and a cover 14 defining an enclosure and a removable light device 16 disposed within the enclosure. Light device 16 is stored within the enclosure until needed, such as during an emergency situation, upon which it can be easily removed as will be described.

Base plate 13 is secured to wall 11 in any appropriate fashion, such as by screws 20 extending through appropriate holes in base plate 13. Other means (permanent or non-permanent) for attaching the base plate to the support surface 18 should be appreciated. It is preferred that the attachment means be inaccessible during normal storage of the light device 16, to prevent unauthorized removal of the entire lighting system from the support surface.

A lower chamber 23 is provided in the enclosure. Lower chamber 23 is defined by a pair of outwardly-projecting walls 24, 25 formed in one piece (unitarily) with base plate 26, and a lower end wall 27, also formed in one piece (unitarily) with base plate 13 and interconnecting sidewalls 24, 25. A lower front door 29 encloses lower chamber 23, and is attached to end wall 27 in an appropriate manner, such as with a hinge 30. A mechanical lock 31 is provided to prevent unauthorized opening of the lower door 29, without, for example, a key or special tool. The reasons for door 29 will be more fully-described below.

A cup-shaped bracket or holder, indicated generally at 32, extends outwardly from base plate 13. Holder 32 is defined by a back wall 33, front wall 34, lower wall 35, and sidewalls 36, 37. Back wall 33 is fixed to base plate 13, such as with adhesive, to support holder 32 relative to the base plate. While one form of a holder or bracket is described above, other forms are of course anticipated. Such other forms can include, for example, a spring clip, snap clamp, or other holder or bracket device attached to the base plate.

Cover 14 includes a flat front plate 38, which is hingedly connected to sidewalls 24, 25, using conventional means, such as pins 39. Pins 39 are received within corresponding holes in the cover 14 and sidewalls 24, 25. Other appropriate pivotal connecting means between the cover and base plate could also be used. Moreover, the cover could be opened by pulling the cover entirely off of the base plate. In any case, an upper end wall 40 is provided along the upper edge of the front plate 38, and sidewalls 41, 42 are provided along the sides of the cover, in spaced-apart relation to one another. Sidewalls 41, 42 together with upper end wall 40 and holder 32, define an upper chamber, indicated at 43.

The lighting system includes a device that normally prevents closure of the cover after the cover is opened. Referring now to FIGS. 2–4 and 6, the cover includes a short bar or rod 44 attached along the inside surface of the cover and extending vertically downwardly from the lower end of the cover. Rod 44 extends downwardly into lower chamber 23, and follows an arcuate movement when cover 14 is opened, as shown by comparing FIGS. 2 and 4.

An engagement member comprising a spring-biased button 45 is slideable within a holder 46 supported by the lower end wall 27. When cover 14 is closed, rod 44 is normally oriented to engage button 45 (FIGS. 2, 3), and hold the button in a depressed position within holder 46. When cover 14 is opened, rod 44 moves arcuately out of engagement with button 45, which thereby allows button 45 to move upwardly and partially outwardly from holder 46. When button 45 is extended out of its holder (FIG. 4), cover 14 cannot be fully closed, as the button 45 blocks the arcuate return movement of rod 44. This allows easy confirmation of the opening of the cover and the possible removal of the light device. To allow the cover to be moved into its fully closed position, the lower front door 29 is opened (FIG. 6), and the button 45 is manually depressed back into holder 46 to allow rod 44 to move back into its original, vertical position.

Other devices besides rod 44 and button 45 are anticipated to prevent the cover from being closed after it is initially opened. One such device includes a spring-biased or flexible bar which would normally lean against rod 44 when the cover is closed, and then pivot down into blocking relationship with the rod when the cover is opened. The bar could be manipulated back into its original position when door 29 is opened. Other appropriate devices that accomplish the same result are anticipated.

The various components of the enclosure described above can be formed from any appropriate material, such as plastic or metal, using conventional manufacturing techniques, such as stamping or molding.

Figure 5:
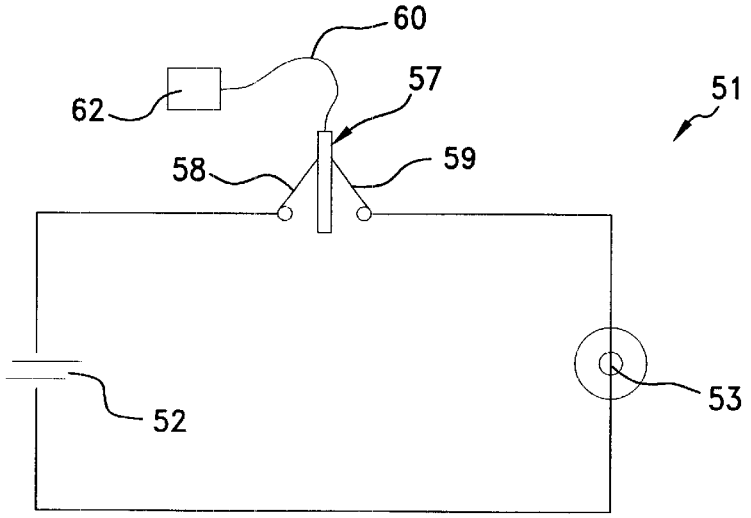
FIG. 5 is a schematic illustration of the electrical circuit for the light device of FIG. 1.

The light device 16 in a first embodiment preferably comprises a portable, battery-operated flashlight that can be supported within the holder 32, and removed when cover 14 is opened. The flashlight is similar in some ways to many conventional, commercially-available flashlights, and includes an outer cylindrical housing 49 and an end cap 50. Referring now also to FIG. 5, the flashlight further includes an electrical circuit, indicated generally at 51, including a source of power (a battery) 52, and a bulb assembly including a light bulb 53 which is surrounded on one side by a reflector and enclosed on the other side by a lens (not shown) in the end cap 50. Battery 52 can be any appropriate type of battery useful for the particular application, such as nickel cadmium, alkaline, etc, and is preferably a relatively inexpensive battery, with a short light span. A rechargeable battery could also be used. The housing 49 for the flashlight is preferably a sealed enclosure made from e.g., plastic or lightweight aluminum, which prevents easy access to battery 52, except during initial assembly (before the housing end cap 50 is sealed to the housing), or only with a special tool.

According to an important aspect of this embodiment, the lighting system includes means to illuminate the light device when the device has been removed from the enclosure, but to prevent the light device from being deactivated, except by an authorized individual. To this end, the light device 16 and cover 14 have cooperating structure which allow the light device to be stored in a non-illuminated condition, but when the cover is open, to automatically (and permanently) illuminate the light device.

Figure 4:
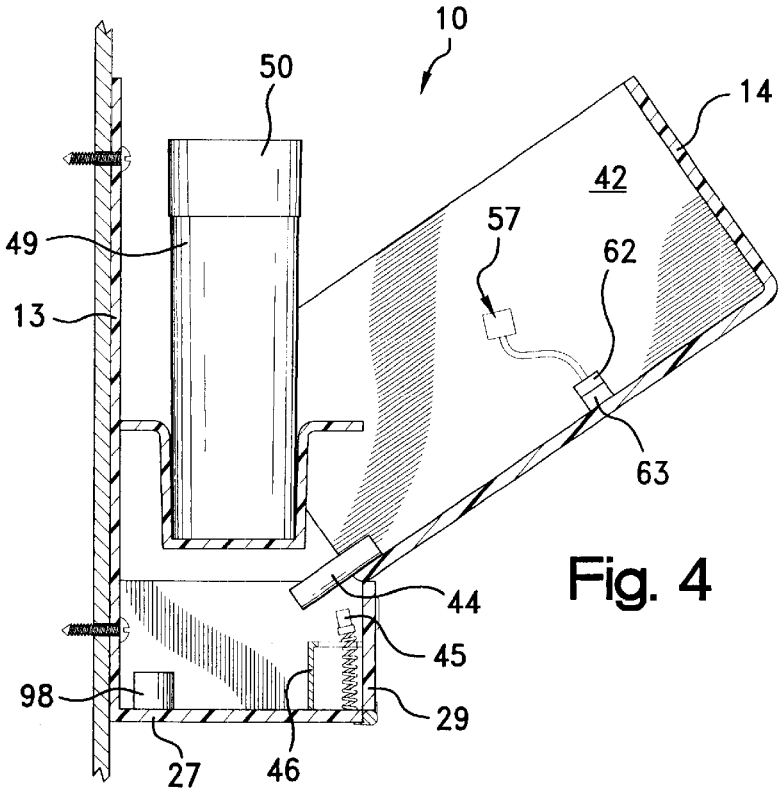
FIG. 4 is a cross-sectional side view similar to FIG. 2, but showing a cover for the enclosure in an open position.
Figure 6:
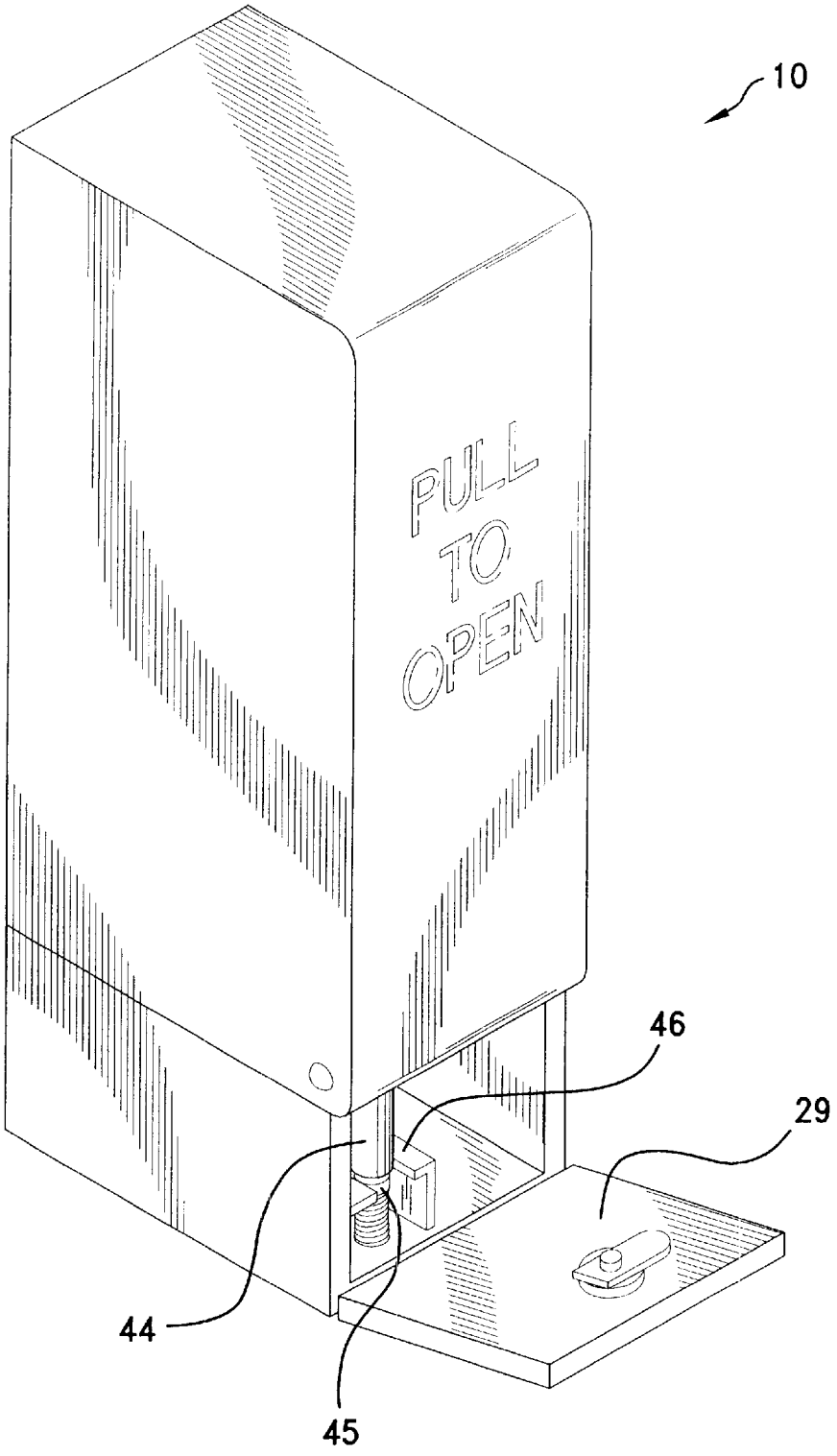
FIG. 6 is a front perspective view of the emergency lighting system similar to FIG. 1, but showing a lower door of the enclosure in an open position.

Preferably, the cooperating structure includes an insulating member, indicated generally at 57 in FIGS. 4 and 5, which is inserted between a pair of contacts 58, 59, to interrupt circuit 51. Contacts 58, 59 can be any appropriate type of contacts, such as metal spring fingers or spring tabs, which are normally biased together to complete the electrical circuit and illuminate the flashlight. When the light device is in a primed, or stored position, insulating member 57 prevents the contacts 58, 59 from contacting each other, thereby opening the circuit 51 and maintaining the flashlight in a non-illuminated condition.

The insulating member 57 is preferably a non-conduction strip or tab of, e.g., plastic, and is installed within a fresh light device at the factory. The non-illuminated flashlight can then be shipped to the facility and loaded into the enclosure at the point of use. Insulating member 57 has a strip or cord 60 that extends through an opening 61 (FIG. 3) in the flashlight housing and terminates in an activating button 62, located exterior to the housing.

The activating button 62 is connected in a convenient manner to the cover 14. To this end, a fastener 63 is provided integral with the cover. Fastener 63 is fixedly attached to the inside surface of the cover such as with adhesive, and becomes fixedly connected to the activating button 62 as the cover is closed. One such fastener can comprise a magnet, adhesively connected to the cover, while the activating button can comprise a metal component that is magnetically attracted to the magnet when the cover 14 is closed. Alternatively, the magnet can be provided with the activating button, and the metal component could be provided with the cover. The activating button and fastener can likewise both be magnetic. In any case, when the cover is opened, the insulating member 57 is drawn out from between the contacts 58, 59 and through opening 61. When this occurs, contacts 58, 59 are biased together, which thereby closes circuit 51 and illuminates bulb 53.

Other cooperating structures are possible, including hook and loop material on the activating button and the inside of the cover, cooperating prongs, or any other device which would allow the insulating member to be fixedly connected to the inside surface of the cover when the cover is closed, and remove the insulating member from between the contacts and through the housing opening when the cover is opened.

The housing is preferably of such a structure that the insulating member 57 cannot easily be inserted between contacts 58, 59 after the insulating member is removed. For example, the path for the insulating member from opening 61 to contacts 58, 59, can be a convoluted path (e.g., a right-angle path). Such a path would prevent easy insertion of the insulating member through the opening and then insertion between the contacts. On the other hand, the insulating member can be easily inserted between the contacts during initial assembly of the flashlight, that is, before the circuit, batteries and bulb assembly are inserted into and sealed within the housing. The strip or cord 60 of the insulating member is then threaded through the opening 61 and the end cap 50 is sealed to the housing.

As described above, after the light device is inserted into the holder and the cover is closed, the insulating member is connected to the cover and the light device is primed and ready for use. During an emergency situation when it is desired to access the lighting device, the user simply opens the cover, illuminating the light device, and removes the light device. The light device remains illuminated for at least as long as necessary for the user to exit the building. At least without a special tool, the insulating member 57 cannot be reinserted between the contacts, and the flashlight thereby remains illuminated until the batteries are spent. It is believed this discourages theft and misuse of the light device, as the device cannot be easily transported around the facility without being noticed, and the light device becomes spent after only a short period of time.

More than one lighting system can of course be provided to aid the occupants in exiting. While only a single flashlight is illustrated, it is noted that multiple flashlights could also be used, each separately mounted within individual holders, or supported within the same (albeit wider) holder of the system.

One or more light devices could also be permanently mounted within each lighting system. Such permanent devices would illuminate the surrounding area when the cover is opened. In any case, after the light device(s) are removed or otherwise spent, a fresh light device can then be loaded into the housing for subsequent use. The spent device can be discarded, or provisions can be made to allow authorized access to the battery and removal and replacement of the battery (or recharging).

Figure 7:
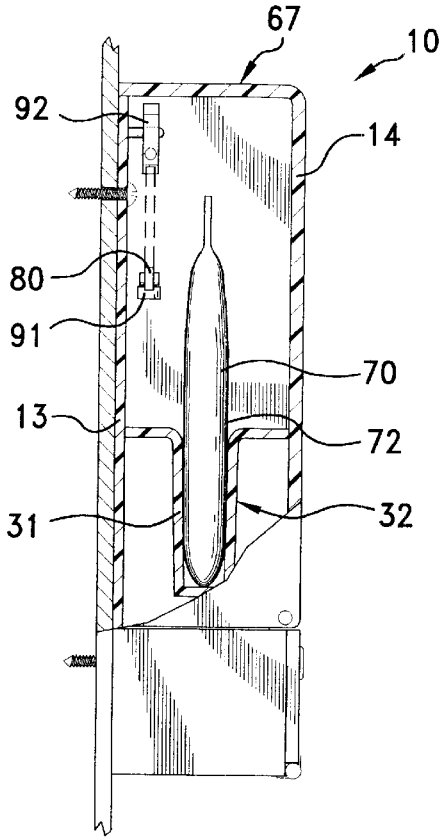
FIG. 7 is a cross-sectional side view of the emergency lighting system showing a second embodiment of the light device.
Figure 8:
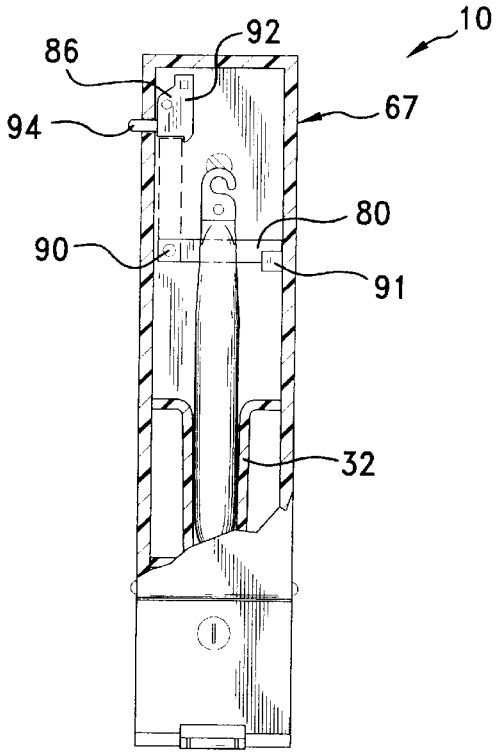
FIG. 8 is a cross-section front view of the lighting system of FIG. 7.
Figure 9:
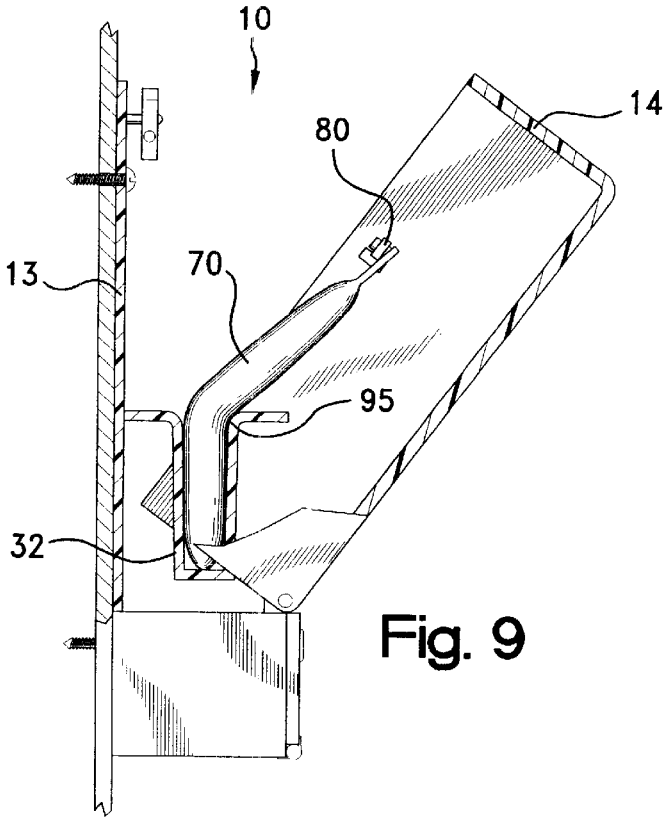
FIG. 9 is a cross-sectional side view of the lighting system similar to FIG. 7, but showing the cover of the enclosure in an open position.

A second embodiment of the light device for the lighting system 10 is illustrated in FIGS. 7–9. In this embodiment, the base plate 13 and cover 14 are preferably the same as in the first embodiment and define an enclosure. Holder 32 is also provided as in the first embodiment. In this second embodiment, however, the light device, identified at 70, comprises a light stick, and is preferably a chemiluminescent light stick. Such light sticks generally include a tubular elongated body 72 that is sealed at both ends and includes two chemicals separated by an internal breakable wall or membrane. The chemicals, when separated, are generally inert, but when the internal wall is ruptured, intermix and cause luminescence. Such a light device can be caused to operate by bending or twisting the outer tubular body until the inner wall is ruptured and the chemicals intermix to cause the luminescence. Further description of such a light stick can be found in U.S. Pat. No. 5,446,629, which to the extent necessary, is incorporated herein by reference.

In any case, light stick 70 is supported within holder 32 in a vertical orientation. The light stick is initially in a primed, or ready condition, where the chemicals are separated and the light stick remains inactive. The light stick 70 is located within the holder 32 when the cover 14 is open, and then the cover is closed to enclose the light stick within the housing.

Similar to the first embodiment above, cover 14 includes a device to automatically activate the light stick when the cover is later opened. Referring first to FIGS. 7 and 8, the activating device includes a break bar 80 pivotally supported on a pin 90. Pin 90 is connected to one of the walls 41, 42 of front cover 14. As can be seen in FIG. 7, the break bar 80 is located in back of light stick 70, that is, it pivots in a plane between the light stick 70 and the base plate 13. The break bar 80 is initially retained in a vertical orientation by latch or tab 92. When cover 14 is to be closed, break bar 80 is vertically oriented so as not to contact light stick 70.

After the cover is closed, an externally-accessible button 94 is manually engaged, to allow break bar 80 to disengage from latch 92. When the break bar is disengaged, the break bar pivots around pin 90 and moves into a substantially horizontal orientation, directly behind light stick 70, and toward the upper portion of the stick. The break bar can be spring-biased to assist in moving the break bar into the horizontal orientation. A stop surface or receptacle 91, which is also connected to the front cover 14, supports the end of break bar 80 in the horizontal orientation. Button 94 may also be positioned such that it is engaged by the base or other structure when the cover is closed to automatically move latch 92 out of supporting engagement with break bar 80. An external magnet can also be used, in which case break bar 80 can also be a metal or magnetic material, with the external magnet being removed after the light stick 70 is loaded into the enclosure so that the break bar then pivots into a position behind the light stick.

When cover 14 is later opened, break bar 80 moves with cover 14, and engages the light stick as the cover is initially opened. As the cover is further opened, as shown in FIG. 9, the break bar bends the light stick around the front edge or lip 95 of holder 32. In so doing, the break bar causes the internal membrane in the light stick to rupture, and the chemicals to intermix. After the cover is opened a sufficient amount, the break bar passes over the end of the light stick, which provides unrestricted, easy access to the light stick. The illuminated light stick 70 can then be easily removed from holder 32, and carried with the occupant to exit the facility.

The emergency lighting system of this embodiment also includes an engagement member that normally prevents closure of the cover after the cover is opened. The member can comprise the spring-biased button 45 described above, or other appropriate alternatives.

The light stick 70 cannot be extinguished after the chemicals have mixed, and remains illuminated until the chemical reaction is spent. Again, it is believed this discourages theft and misuse of the light stick. The break bar 80 also can not be removed from its primed position (behind the light stick), after the tab 92 is released, which prevents the light stick from being removed from the housing in an non-illuminated condition. This also prevents misuse of the light device.

Again, more than one light stick can be provided in the emergency lighting system, and one or more light sticks could be permanently mounted.

Further features of the present invention can also be provided, such as one or more blinking LEDs as at 96 (FIG. 1), powered by batteries 98 (FIG. 4) to indicate the proper priming of the light device, and to facilitate identifying the device in a dark or smoke-filled room. A smoke detector 99 with an audible signal could also be included in the lighting system, and connected to batteries 98. Batteries 98 for such LEDs and smoke detector are also preferably contained within lower chamber 23, and accessible when the lower door is open.

The lighting system can also provide a visual indication that the cover for the device has been opened, and thus that a light device might have been removed. One means for accomplishing this is to have button 45 incorporated into a contact switch between battery 98 and LEDs 96, such that an LED is turned off when the cover is opened. The button would be reset only upon access through door 29. In the same way, an audible device 102 can also be provided to give an indication that the door has been opened. The circuit connections to accomplish this should be well-apparent to those of ordinary skill in the art. Alternatively, a mechanical flag or other visual device could be provided to indicate that the cover has been opened. The flag could be engaged by rod 44 or a portion of the cover when the cover is opened. Such means could be reset with a key or access through door 29. The cover 14 could also have a break-away feature which would be noticeable when the cover is opened to provide a visual indication that a light device may have been removed.

Still further, the LEDs 96 and audible device 102 could be connected to provide a visual or audible indication that the light device needs to be serviced (e.g., when the battery in the flashlight needs to be replaced). A timing circuit could be connected to LEDs 96 and/or audible device 102 for this purpose.

As such, the present invention provides a novel and unique emergency lighting system with a light device which automatically illuminates when a cover for the device is opened, and can be easily removed and carried by an occupant to illuminate an exit passage. An important aspect is that the light device is automatically and irreversibly activated upon removal so as to deter theft and misuse.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A lighting system, comprising:

(1) a base plate, and a cover connected to the base plate which together with the base plate defines an enclosure when the cover is in a closed position, said cover moveable away from the base plate to an open position;

(2) a portable light device removably supported with the enclosure, the light device including a light bulb, a source of power for the light device and an electrical circuit interconnecting the light bulb and the source of power, said base plate including a holder supporting said light device and allowing the light device to be removed when the cover is in the open position, said cover including a fastener device connected thereto, and said light device including a circuit interruption device interrupting the electrical circuit and maintaining the circuit in an open condition and the light device in a non-illuminated condition, the fastener device and circuit interrupting device cooperating when the cover is moved to an open position such that the circuit interrupting device is moved out of interruption with the electrical circuit to allow the electrical connection between the light device and the source of power to close and the light device to illuminate such that the illuminated light device can be removed from the enclosure.

2. The lighting system as in claim 1, wherein the light device comprises a flashlight, said flashlight including a bulb and at least one battery interconnected by the electrical circuit, said circuit interrupting device including an insulating member which physically separates a pair of normally-closed contacts within the electrical circuit, and is removed from between the contacts by the cooperation with the fastener device to allow closure of the contacts when the cover is in the open position.

3. The lighting system as in claim 2, wherein said flashlight includes a housing, and an opening is formed in the housing at a location such that said insulating member is removed through the opening when the cover is opened.

4. The lighting system as in claim 3, wherein the path between the opening in the housing and the pair of contacts is a convoluted path, which prevents the insulating member from being reinserted through the opening and between the pair of contacts after the insulating member is removed.

5. The lighting system as in claim 2, wherein the fastener device is fixedly attached to the cover, the fastener device normally being a separate component from the insulating member, and becoming fixedly connected to the insulating member when the cover is closed, such that the fastener device draws the insulating member out from between the electrical contacts when the cover is moved to the open position.

6. The lighting system as in claim 1, wherein said cover is pivotally connected to the base plate.

7. The lighting system as in claim 1, further including a closure prevention device which prevents the cover from being moved back to the closed position after the cover is moved to the open position.

8. The lighting system as in claim 7, wherein said closure prevention device includes a rod fixed to the cover, and a button supported by the base, said rod and base cooperating when the cover is in the closed position to retain the button in a first position, and said rod moveable when the cover is moved to the open position to allow the button to move to a second, blocking position, said rod engaging the button when the cover is then closed to prevent the cover from being fully closed.

9. The lighting system as in claim 8, further including a normally inaccessible chamber, said chamber being accessible to allow manual access to the button to force the button into the first position and allow the cover the be fully closed.

10. A portable flashlight including a housing having an opening, the housing enclosing a light bulb, a source of power for the light bulb and an electrical circuit interconnecting the light bulb and the source of power, said electrical circuit including a pair of contacts normally biased into electrically-closed condition with one another to complete the circuit between the light bulb and the source of power, a flexible insulating member interposed between the pair of contacts to separate the contacts and interrupt the circuit between the light bulb and the source of power, said insulating member having an externally-accessible portion extending outwardly through the opening in the housing, wherein the insulating member prevents illumination of the flashlight when interposed between the contacts, and is removable from between the contacts by pulling on the externally accessible portion, and when removed, allowing the contacts to come into contact with one another to illuminate the flashlight.

11. The portable flashlight as in claim 10, wherein the pair of contacts in the electrical circuit comprises a pairs of spring fingers.

12. The portable flashlights in claim 10, wherein the externally accessible portion of the insulating member terminates in an actuating button having means for attachment to an external member.

13. The portable flashlight as in claim 10, wherein the insulating member comprises a strip or cord.

14. A portable flashlight including a housing having an opening, the housing enclosing a light bulb, a source of power for the light bulb and an electrical circuit interconnecting the light bulb and the source of power, said electrical circuit including a pair of contacts normally biased into electrically-closed condition with one another to complete the circuit between the light bulb and the source of power, an insulating member interposed between the pair of contacts to separate the contacts and interrupt the circuit between the light bulb and the source of power, said insulating member having an externally-accessible portion extending outwardly through the opening in the housing, wherein the insulating member prevents illumination of the flashlight when interposed between the contacts, and is removable from between the contacts by pulling on the externally accessible portion, and when removed, allowing the contacts to come into contact with one another to illuminate the flashlight, wherein the path between the opening in the housing and the pair of contacts is a convoluted path, which prevents the insulating member from being reinserted through the opening and between the pair of contacts after the insulating member is removed.

15. A lighting system, comprising:

a base plate, and the cover connected to the base plate and which together with the base plate defines an enclosure when the cover is in a closed position, said cover movable away from the base plate to an open position to allow access to the enclosure; and a light stick removably supported within a holder in the enclosure, the enclosure including a break bar moveably mounted to the cover, said break bar moveable into a first position where the break bar interferes with the light stick when the cover is moved from the closed position to the open position to thereby bend the light stick around an edge of the holder, rupture an internal membrane in the light stick, and cause the light stick to illuminate, said break bar moveable into a second position allowing the cover to be moved from an open position to a closed position where the break bar does not interfere with the light stick.

16. The lighting system as in claim 15, wherein said cover is pivotally attached to the base plate, and said breaker bar is pivotally attached to the cover.

17. The lighting system as in claim 8, further including a latch retaining the break bar in the second position, said latch being manually manipulable to allow the break bar to move into the first position.

18. The lighting system as in claim 15 wherein said cover is pivotally connected to the base plate.

19. The lighting system as in claim 15 further including a closure prevention device which prevents the cover from being moved back to the closed position after the cover is moved to the open position.

20. The lighting system as in claim 19, wherein said closure prevention device includes a rod fixed to the cover, and a button supported by the base, said rod and base cooperating when the cover is in the closed position to retain the button in a first position, and said rod moveable when the cover is moved to the open position to allow the button to move to a second, blocking position, said rod engaging the button when the cover is then closed to prevent the cover from being fully closed.

21. The lighting system as in claim 20 further including a normally inaccessible chamber, said chamber being accessible to allow manual access to the button to force the button into the first position and allow the cover to be fully closed.

22. A lighting system, comprising:

(i) a base plate, and a cover connected to the base plate which together with the base plate defines an enclosure when the cover is in a closed position, said cover moveable away from the base plate to an open position;

(ii) a portable light device removably supported with the enclosure normally in a non-illuminated condition, said base plate supporting said light device when the cover is in the closed position and allowing the light device to be removed when the cover is in the open position, said cover including an activating assembly, the activating assembly cooperating with the light device to illuminate the light device when the cover is opened so that the illuminated light device can be removed from the enclosure; and (iii) a device for preventing the cover from being fully closed after the cover is opened.

23. The lighting system as in claim 22 further including a chamber in the enclosure separate from the light device, said closure preventing device disposed in the chamber, and a door covering an opening to the chamber, said door being openable to permit access to the closure preventing device in the chamber.

24. The lighting system as in claim 23, wherein said cover is pivotally attached to the base plate, and said activating assembly is attached to the cover.

25. The lighting system as in claim 24 wherein said closure preventing device includes a rod connected to the cover and projecting into the chamber, said rod pivoting around a pivot axis when the cover is opened, said rod cooperating with a spring-biased button disposed in said chamber, said button preventing said cover from being fully closed when said cover is moved into the position, and wherein said button can be manually manipulated by access through said door to allow said cover to be fully closed.

* * * * *